US009134701B2

(12) United States Patent
Bucaille

(10) Patent No.: US 9,134,701 B2
(45) Date of Patent: Sep. 15, 2015

(54) TIMEPIECE MOVEMENT WITH A BALANCE AND HAIRSPRING

(75) Inventor: Jean-Luc Bucaille, Beaumont (FR)

(73) Assignee: PATEK PHILIPPE SA GENEVE, Geneva (CH)

( * ) Notice: Subject to any disclaimer, the term of this patent is extended or adjusted under 35 U.S.C. 154(b) by 0 days.

(21) Appl. No.: 14/238,536

(22) PCT Filed: Sep. 4, 2012

(86) PCT No.: PCT/IB2012/001700

§ 371 (c)(1),
(2), (4) Date: Feb. 12, 2014

(87) PCT Pub. No.: WO2013/034962

PCT Pub. Date: Mar. 14, 2013

(65) Prior Publication Data

US 2014/0192627 A1 Jul. 10, 2014

(30) Foreign Application Priority Data

Sep. 7, 2011 (CH) ..... 1473/11

(51) Int. Cl.
*G04B 17/06* (2006.01)
*G04B 17/26* (2006.01)

(52) U.S. Cl.
CPC ..... *G04B 17/06* (2013.01); *G04B 17/066* (2013.01); *G04B 17/26* (2013.01)

(58) Field of Classification Search
CPC ..... G04B 17/06; G04B 17/066; G04B 17/20; G04B 17/26
USPC ..... 368/171, 175
See application file for complete search history.

(56) References Cited

U.S. PATENT DOCUMENTS

| | | | | |
|---|---|---|---|---|
| 7,344,302 | B2 | 3/2008 | Musy et al. | |
| 8,002,460 | B2 * | 8/2011 | Daout et al. | 368/175 |
| 8,348,497 | B2 | 1/2013 | Daout | |
| 2006/0055097 | A1 * | 3/2006 | Conus et al. | 267/273 |
| 2006/0262652 | A1 * | 11/2006 | Musy et al. | 368/175 |
| 2009/0116343 | A1 * | 5/2009 | Levingston | 368/140 |
| 2011/0069591 | A1 * | 3/2011 | Daout | 368/175 |

FOREIGN PATENT DOCUMENTS

| | | | |
|---|---|---|---|
| DE | 10 2009 048733 | A1 | 4/2011 |
| EP | 1 473 604 | A1 | 11/2004 |
| EP | 2 299 336 | A2 | 3/2011 |

OTHER PUBLICATIONS

E. Michel et al., "Spiraux plats concentriques sans courbes", Bulletin Annuel De La Societe Suisse De Chronometrie Et Dulaboratoire Suisse De Recherches Horlogeres, Societe Suisse De Chronometrie. Neuchatel, CH, vol. IV, Jan. 1, 1963, pp. 162-169.

* cited by examiner

*Primary Examiner* — Vit W Miska
(74) *Attorney, Agent, or Firm* — Young & Thompson

(57) ABSTRACT

A timepiece movement includes a balance-and-hairspring regulator and an escapement co-operating with the regulator, the outer turn (5) of the hairspring including a stiffened portion (6'; 6"; 6"') arranged to make the development of the hairspring more concentric, is characterized in that the stiffened portion (6'; 6"; 6"') is also arranged to at least partially compensate for the variation in the rate of the movement in dependence upon the oscillation amplitude of the balance caused by the escapement.

17 Claims, 7 Drawing Sheets

TIMEPIECE MOVEMENT WITH A BALANCE AND HAIRSPRING

The present invention relates to a timepiece movement, more particularly a movement comprising a balance-and-hairspring type regulator and an escapement.

Whilst the balance of a conventional balance-and-hairspring regulator is oscillating, the hairspring develops eccentrically owing to the fact that its centre of gravity is not on the axis of the regulator and is moving. This eccentric development generates large return forces between the pivots of the shaft of the regulator and the bearings in which they rotate, which forces furthermore vary in dependence upon the oscillation amplitude. These return forces disturb the oscillations of the balance and affect the isochronism of the movement, i.e., increase the rate variations in dependence upon the oscillation amplitude. To overcome this problem, the present applicant has proposed, in its patent EP 1473604, a balance-and-hairspring regulator whose outer turn of the hairspring has a stiffened portion arranged to make the development of the hairspring concentric.

However, it is known that the concentricity of the development of a hairspring is not the only factor which has an influence on isochronism. Mounted in a movement, the regulator is disturbed by the escapement which causes a rate loss. In fact, during the unlocking phase, the regulator is subjected to a resistant torque before the line of centres, and this causes a loss. During the impulse phase, the regulator is subjected to a drive torque firstly before the line of centres, which causes a gain, then after the line of centres, which causes a loss. Overall, the escapement thus produces a rate loss and this disturbance caused by the escapement is greater for small oscillation amplitudes of the balance than it is for large oscillation amplitudes of the balance.

The present invention aims to further improve the ischronism of a balance-and-hairspring regulator and to this end proposes a timepiece movement comprising a balance-and-hairspring regulator and an escapement co-operating with the regulator, the outer turn of the hairspring comprising a stiffened portion arranged to make the development of the hairspring more concentric, characterised in that the stiffened portion is also arranged to at least partially compensate for the variation in the rate of the movement in dependence upon the oscillation amplitude of the balance caused by the escapement.

It has been surprisingly noted that by experimenting with the arrangement of the stiffened portion of the outer turn of the hairspring, for example its position, extent or thickness, the overall isochronism of the movement, taking into account the disturbance caused by the non-concentricity of the hairspring and also the disturbance caused by the escapement, could be clearly improved with respect to the regulator described in patent EP 1473604.

Advantageously, the stiffened portion is arranged to produce a rate gain of at least 2 s/d, or at least 4 s/d, or even at least 6 s/d, or even at least 8 s/d, at an amplitude of 150° with respect to an amplitude of 300°, at least partially compensating for said rate variation caused by the escapement.

In accordance with a first embodiment, the stiffened portion is closer to the outer end of the hairspring than a theoretical stiffened portion which would make the development of the hairspring substantially perfectly concentric, the thickness and extent of the stiffened portion being able to be substantially identical to those of said theoretical stiffened portion.

In accordance with a second embodiment, the stiffened portion is thinner than a theoretical stiffened portion which would make the development of the hairspring substantially perfectly concentric, the position and extent of the stiffened portion being able to be substantially identical to those of said theoretical stiffened portion.

In accordance with a third embodiment, the stiffened portion is less extended than a theoretical stiffened portion which would make the development of the hairspring substantially perfectly concentric, the position and thickness of the stiffened portion being able to be substantially identical to those of said theoretical stiffened portion.

Other features and advantages of the present invention will become apparent upon reading the following detailed description with reference to the accompanying drawings, in which.

Figure 1:
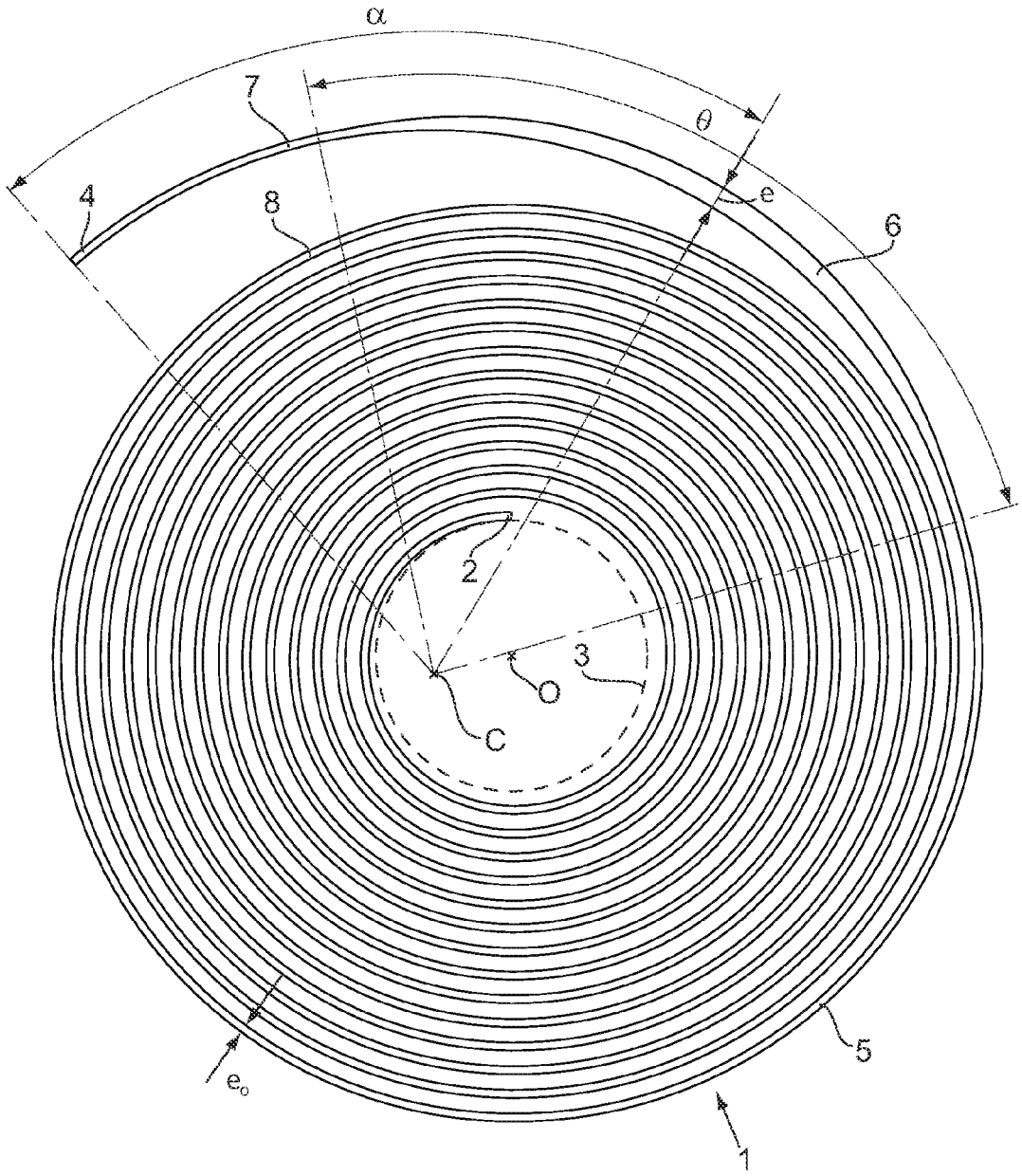
FIG. 1 shows a hairspring having a stiffened outer turn portion in accordance with the prior art, a collet associated with this hairspring being shown schematically by a dashed line.

FIG. 1 shows a flat hairspring of the type described in patent EP 1473604 for a balance-and-hairspring regulator of a timepiece movement. This hairspring, designated by reference numeral 1, is in the shape of an Archimedean spiral and is fixed by its inner end 2 to a collet 3 mounted on the shaft of the balance and by its outer end 4 to a stud (not shown) mounted on a fixed part of the movement such as the balance-cock. The spring 1-collet 3 assembly can be formed in a single piece, in a crystalline material such as silicon or diamond, by a micro-etching technique. The outer turn 5 of the hairspring 1 has, locally, a portion 6 which has a greater thickness e than the rest of the strip forming the hairspring. This thickness e which can vary along the portion 6 as shown, stiffens the portion 6 and thus makes it substantially inactive as the hairspring develops. The position and extent of the stiffened portion 6 are selected such that the centre of deformation of the hairspring, substantially corresponding to the centre of gravity of the part of the hairspring other than the stiffened portion 6, is substantially coincident with the geometric centre O of the hairspring, which coincides with the centre of rotation of the collet 3. In so doing, the development of the hairspring is concentric or almost concentric. In practice, the stiffened portion 6 ends before the outer end 4 of the hairspring. This outer end 4, more precisely a terminal part 7 of the outer turn 5 including the stiffened portion 6, is radially offset towards the exterior with respect to the course of the Archimedean spiral to ensure that the penultimate turn 8 remains radially free, i.e., it does not contact any element such as the stud, the outer turn or a regulator pin, during operation of the movement. The spacing between the terminal part 7 and the penultimate turn 8 must be greater than that of a conventional hairspring since the penultimate turn 8, owing to the concentric development of the hairspring, moves radially further towards the stud during expansion of the hairspring. The terminal part 7 is in the form of a circular arc with centre C. The angular extent θ of the stiffened portion 6 and its angular position α (defined for example by the angular position of the centre of the stiffened portion 6 with respect to the angular position of the outer end 4) are defined from this centre C. The thickness e is measured along a radius starting from this centre C. In the illustrated example, the values θ and α are, respectively, 85.9° and 72° and the maximum of the thickness e is 88.7 μm. The thickness $e_0$ of the strip forming the hairspring (measured along a radius starting from the geometric centre O of the hairspring), except for the stiffened portion 6, is 32.2 μm.

Figure 2:
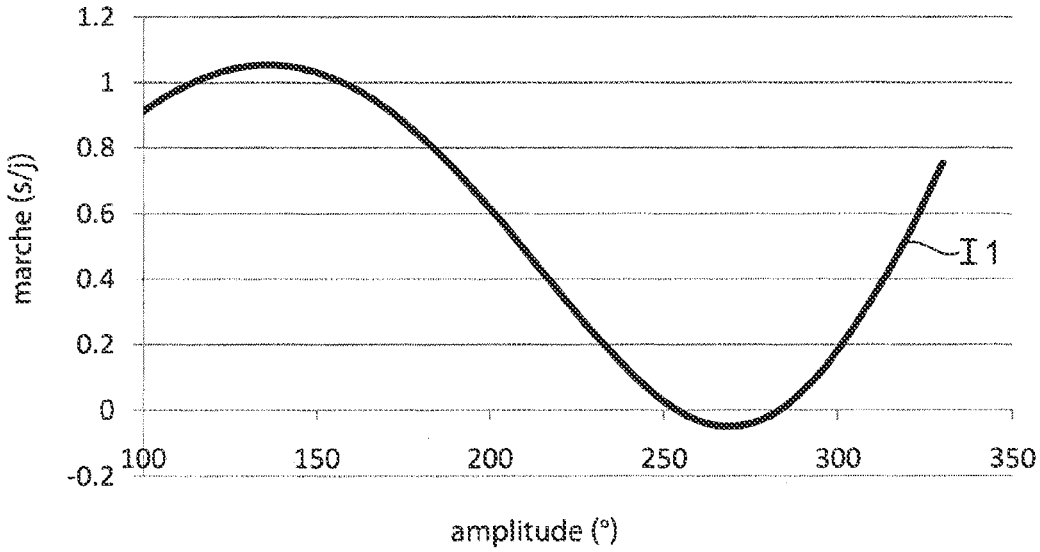
FIG. 2 shows an isochronism curve obtained by digitally simulating the movements of the geometric centre of the hairspring shown in FIG. 1, the regulator or oscillator which this hairspring forms part of being considered to be free, i.e., not subjected to the action of an escapement.

FIG. 2 is an isochronism diagram obtained with the hairspring shown in FIG. 1 by digital simulation. More precisely, the diagram of FIG. 2 is obtained by considering the outer end 4 as being fixed and the shaft on which the collet 3 and the balance are fixed as being free (i.e., not mounted in bearings), by calculating, by finite elements, the movement of the geometric centre O of the hairspring as the balance oscillates, then by interpolating and integrating the movement curve as a function of the oscillation amplitude. The x-axis of the diagram shows the oscillation amplitude of the balance in degrees with respect to the equilibrium position and the y-axis shows the rate in seconds per day. As can be seen, the rate deviation between an oscillation amplitude of 150° and an oscillation amplitude of 300° is in the order of 1 s/d which is excellent. However, this diagram does not take into account the disturbances caused by the escapement.

Figure 3:
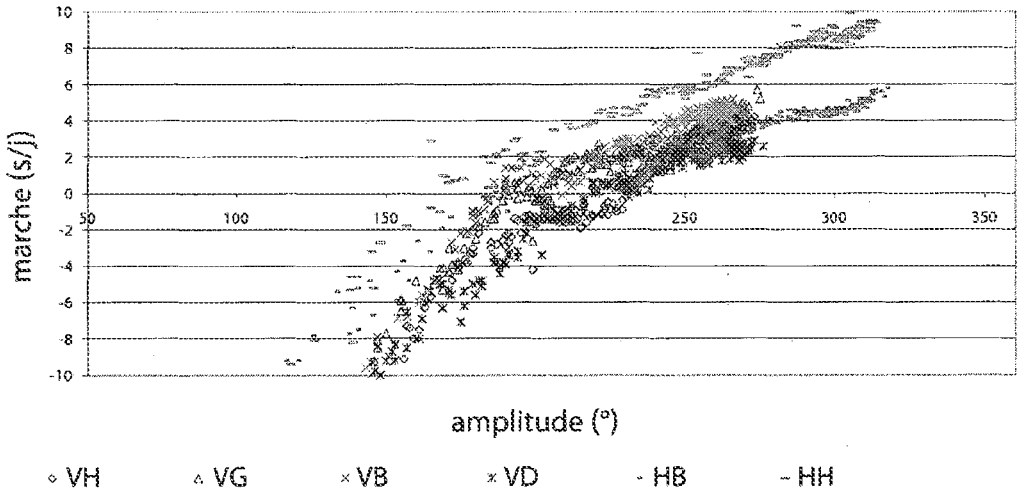
FIG. 3 shows overall isochronism measurement results obtained on a real movement having a hairspring as shown in FIG. 1.

Measurements were taken on twenty movements of identical design, equipped with the hairspring as shown in FIG. 1 and a conventional escapement. For each movement, in each of six different positions (VH: vertical, high; VG: vertical, left; VB: vertical, low; VD: vertical, right; HB: horizontal, low; and HH: horizontal, high), the rate of the movement was measured during the relaxing of its mainspring and the measurements were plotted on a graph. By way of example, the graph obtained for one of these movements is shown in FIG. 3. The y-axis shows the rate in s/d and the x-axis shows the oscillation amplitude of the balance, which decreases progressively between the completely wound state and the unwound state of the mainspring of the movement owing to the reduction in the force of the mainspring. As can be seen, the rate decreases progressively as the oscillation amplitude decreases. For each position of each movement, a curve was interpolated and the rate deviation between the oscillation amplitude of 150° and the oscillation amplitude of 300° was determined. The average of the rate deviations for all the positions and all the movements was about 6.7 s/d between said amplitudes. In other words, the rate at 150° was, on average, less than the rate at 300° by about 6.7 s/d. This decrease in the rate, or loss at small amplitudes with respect to large amplitudes, is essentially caused by the escapement.

The present inventor(s) has (have) noted that the decrease in the rate caused by the escapement could, at least in part, be compensated for by modifying the arrangement of the stiffened portion 6, i.e., for example its position α and/or its extent θ and/or its thickness e with respect to the arrangement of FIG. 1 which gives the turns of the hairspring a perfect, or almost perfect, concentricity.

Figure 4:
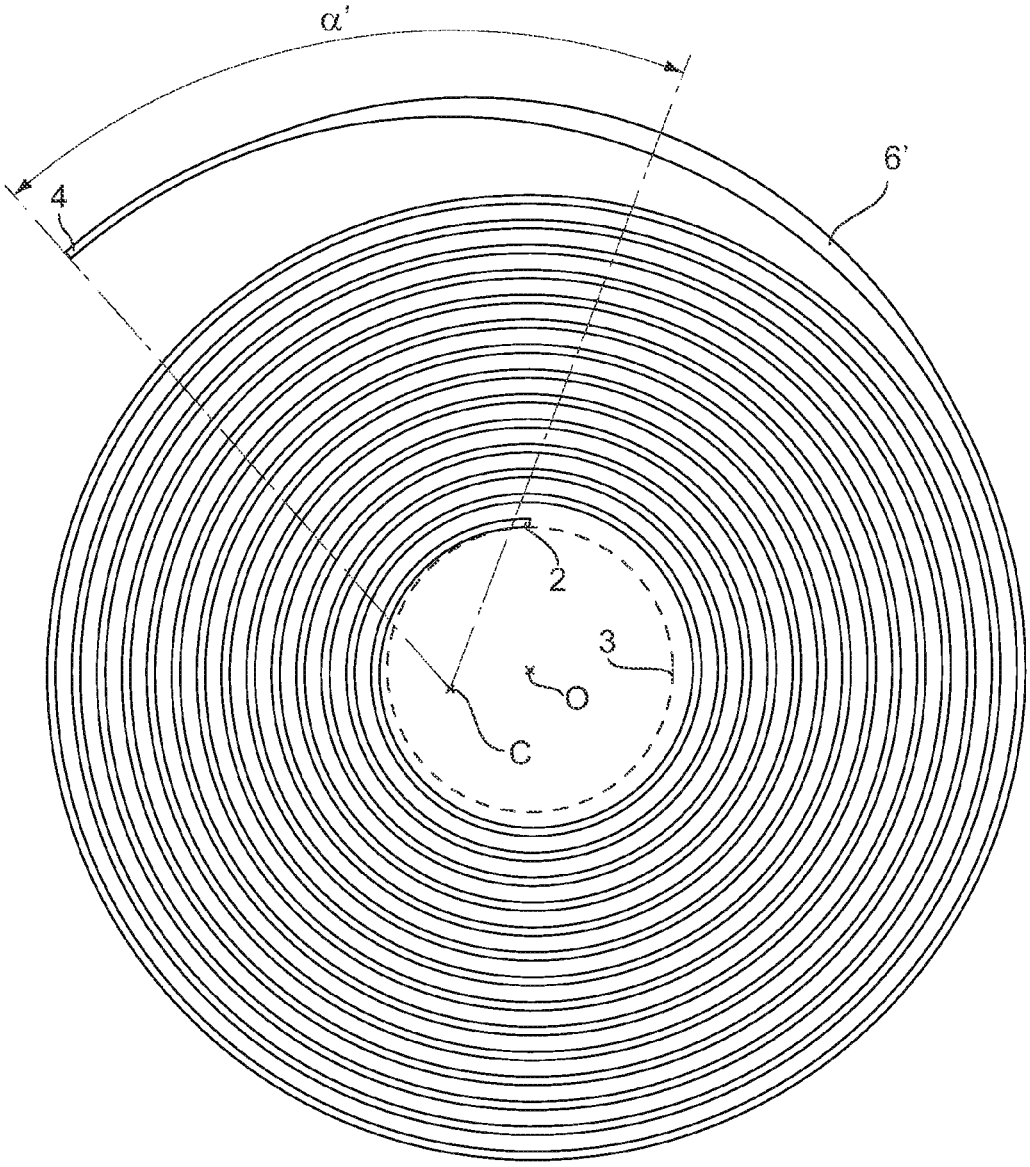
FIG. 4 shows a hairspring having a stiffened outer turn portion in accordance with a first embodiment of the invention.
Figure 5:
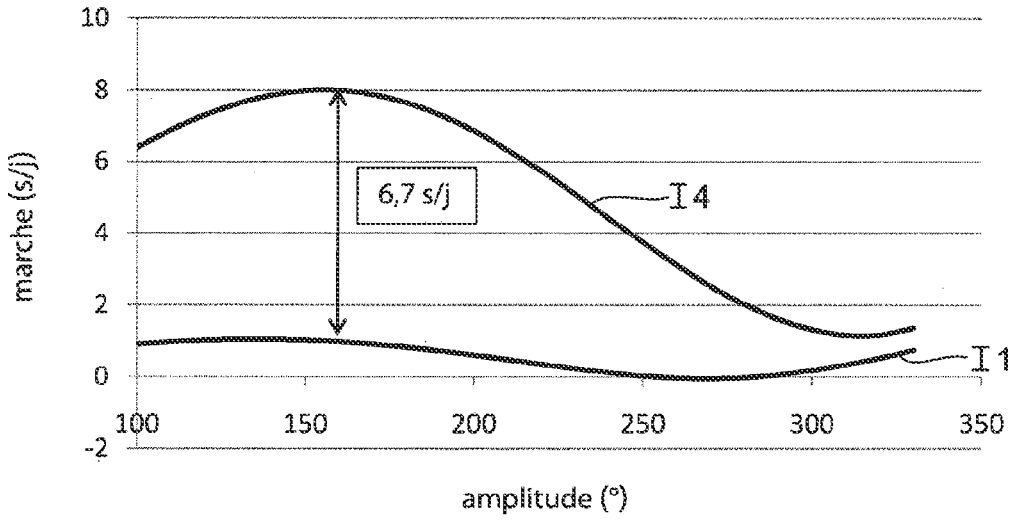
FIG. 5 shows an isochronism curve obtained by digitally simulating the movements of the geometric centre of the hairspring shown in FIG. 4, the regulator or oscillator which this hairspring forms part of being considered to be free, i.e., not subjected to the action of an escapement.
Figure 6:
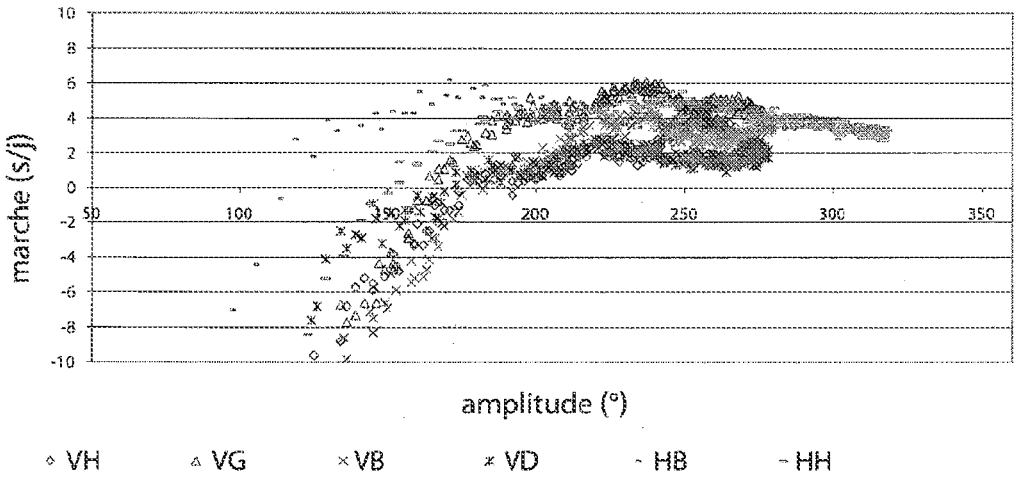
FIG. 6 shows overall isochronism measurement results obtained on a real movement having a hairspring as shown in FIG. 4.

It was discovered in particular that a parameter of the stiffened portion 6 having a particular influence on the isochronism is its position α By moving the stiffened portion 6 towards the outer end 4 of the hairspring, a rate gain is produced at small oscillation amplitudes with respect to large oscillation amplitudes of the balance. Thus, a rate deviation of about 6.7 s/d, but with the opposite sign compared with the average, measured rate deviation mentioned above, can be obtained between the amplitudes of 150° and 300° by moving the stiffened portion 6 to the position α'=62° and by keeping the other characteristics of the stiffened portion 6 (extent, thickness) constant. The rate variation caused by the escapement can thus be substantially fully compensated for. FIG. 4 shows the new hairspring obtained, with its stiffened outer turn portion designated by reference numeral 6'. The movement of the stiffened portion 6 of course modifies the development of the hairspring which is no longer as concentric. However, on the one hand, this modification is small—the hairspring still develops in a manner more concentric than a conventional hairspring (i.e., a hairspring without a stiffened portion)—and, on the other hand, this modification contributes to improving the overall isochronism of the movement. The diagram of FIG. 5 shows the isochronism curve I4 of the hairspring shown in FIG. 4, obtained using the same method as for FIG. 2. It can be seen that the increase in the rate between the amplitude of 300° and the amplitude of 150° is substantially linear and with an inverse slope compared with the slope of the rate variation caused by the escapement. The isochronism curve I1 of the hairspring shown in FIG. 1 has also been plotted on this FIG. 5 for comparison purposes. FIG. 6 shows the results of measuring the rate of a movement identical to that on which the measurements in FIG. 3 were taken, but equipped with the hairspring shown in FIG. 4 instead of that in FIG. 1. These results show that the rate variation was significantly reduced by moving the stiffened portion to the position α', in particular in the range of amplitudes from 180° to 300° where the general shape of the graph is flat.

Figure 7:
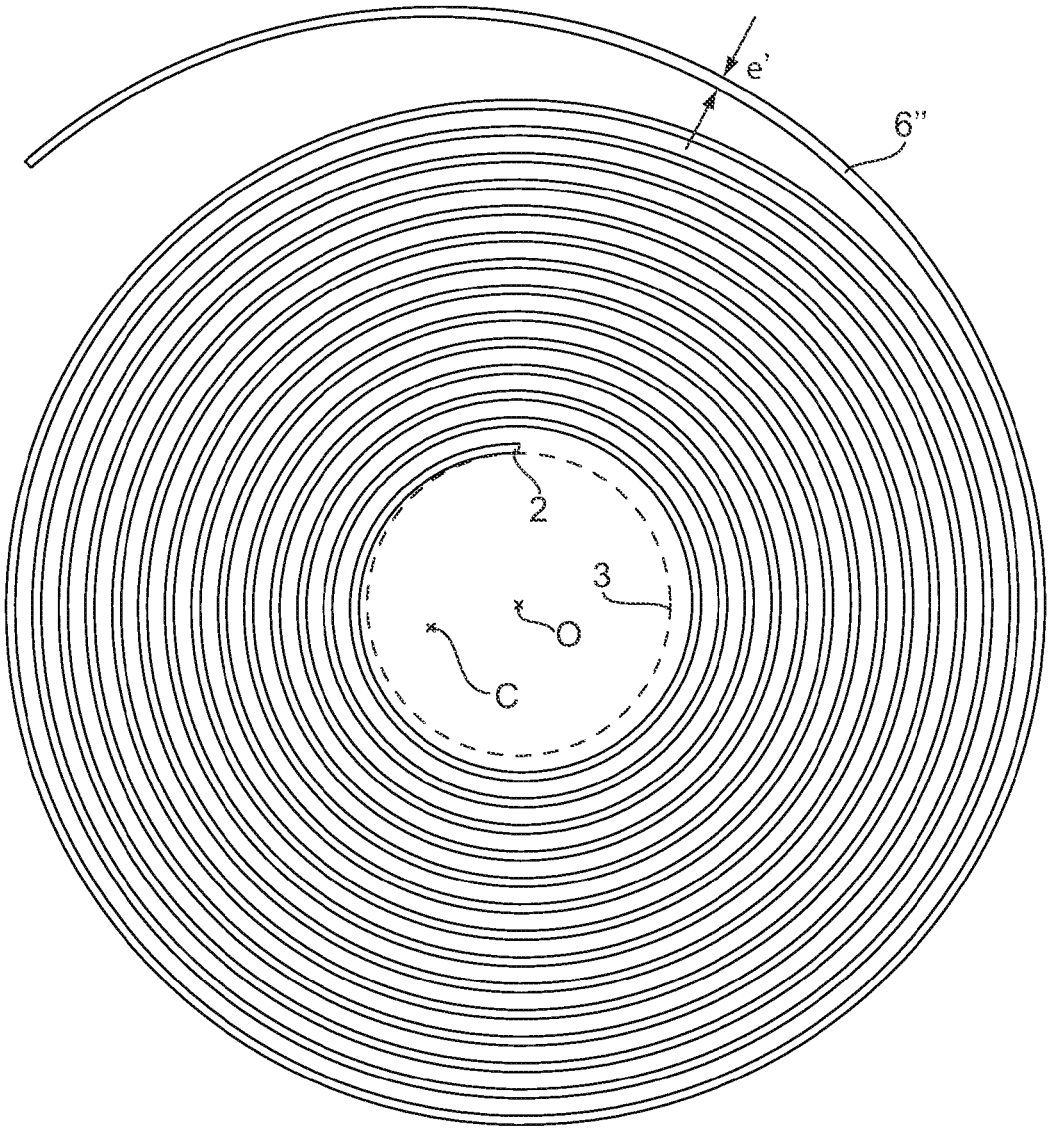
FIG. 7 shows a hairspring having a stiffened outer turn portion in accordance with a second embodiment of the invention.
Figure 8:
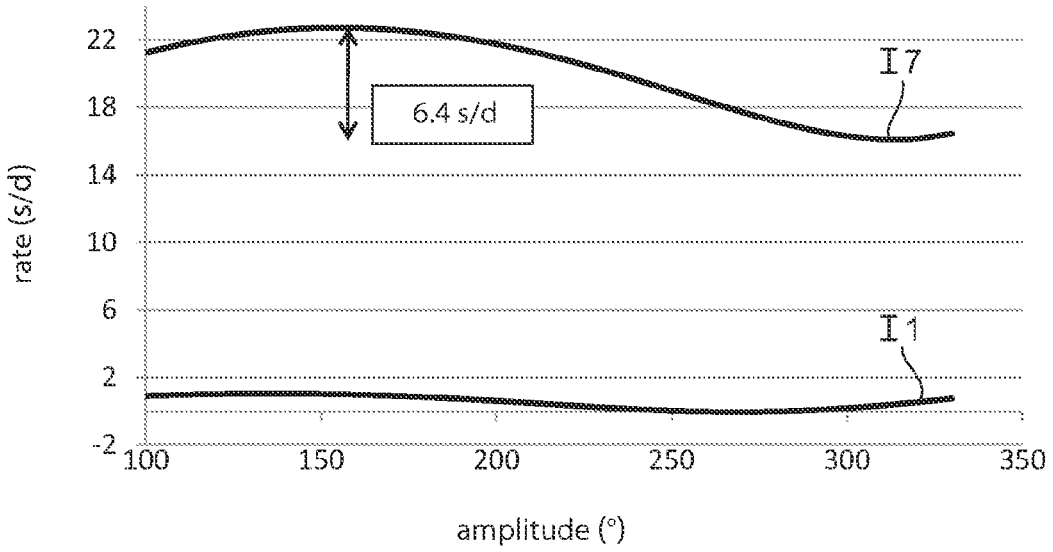
FIG. 8 shows an isochronism curve obtained by digitally simulating the movements of the geometric centre of the hairspring shown in FIG. 7, the regulator or oscillator which this hairspring forms part of being considered to be free, i.e., not subjected to the action of an escapement.

Another parameter of the stiffened portion 6 having an influence on the isochronism is its thickness e. By decreasing the thickness e, a rate gain is produced at small oscillation amplitudes with respect to large oscillation amplitudes of the balance. Thus, for example, a rate deviation of about 6.4 s/d, but with the opposite sign compared with the average, measured rate deviation mentioned in relation to FIG. 3, can be obtained between the amplitudes of 150° and 300° by decreasing the maximum of the thickness e of the stiffened portion 6 (and the remaining thickness proportionally) to the value e'=44.2 μm and by keeping the other characteristics of the stiffened portion (position, extent) constant. FIG. 7 shows the hairspring obtained, with its stiffened outer turn portion designated by reference numeral 6", and FIG. 8 shows the isochronism curve I7 corresponding to such a hairspring.

Figure 10:
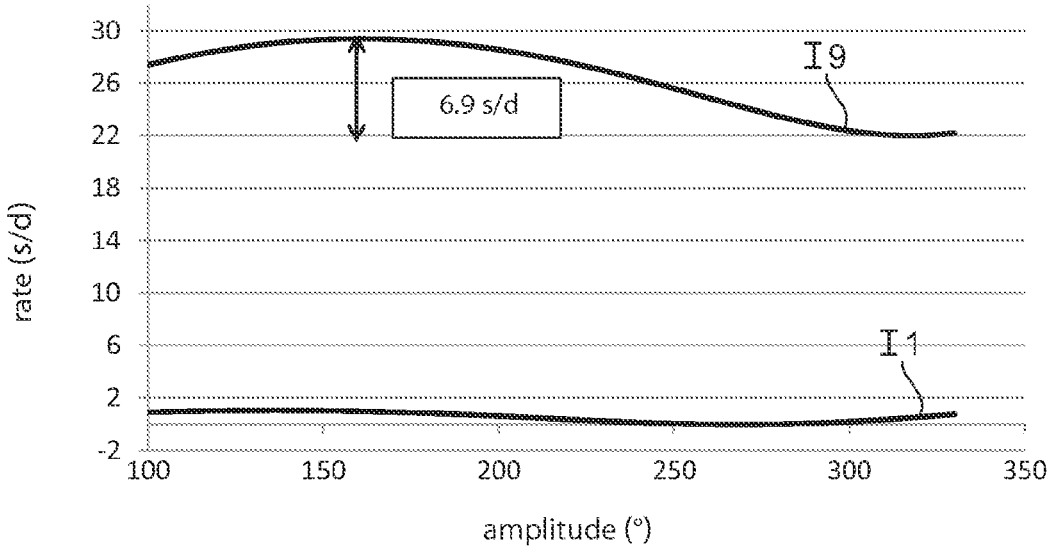
FIG. 10 shows an isochronism curve obtained by digitally simulating the movements of the geometric centre of the hairspring shown in FIG. 9, the regulator or oscillator which this hairspring forms part of being considered to be free, i.e., not subjected to the action of an escapement.
Figure 9:
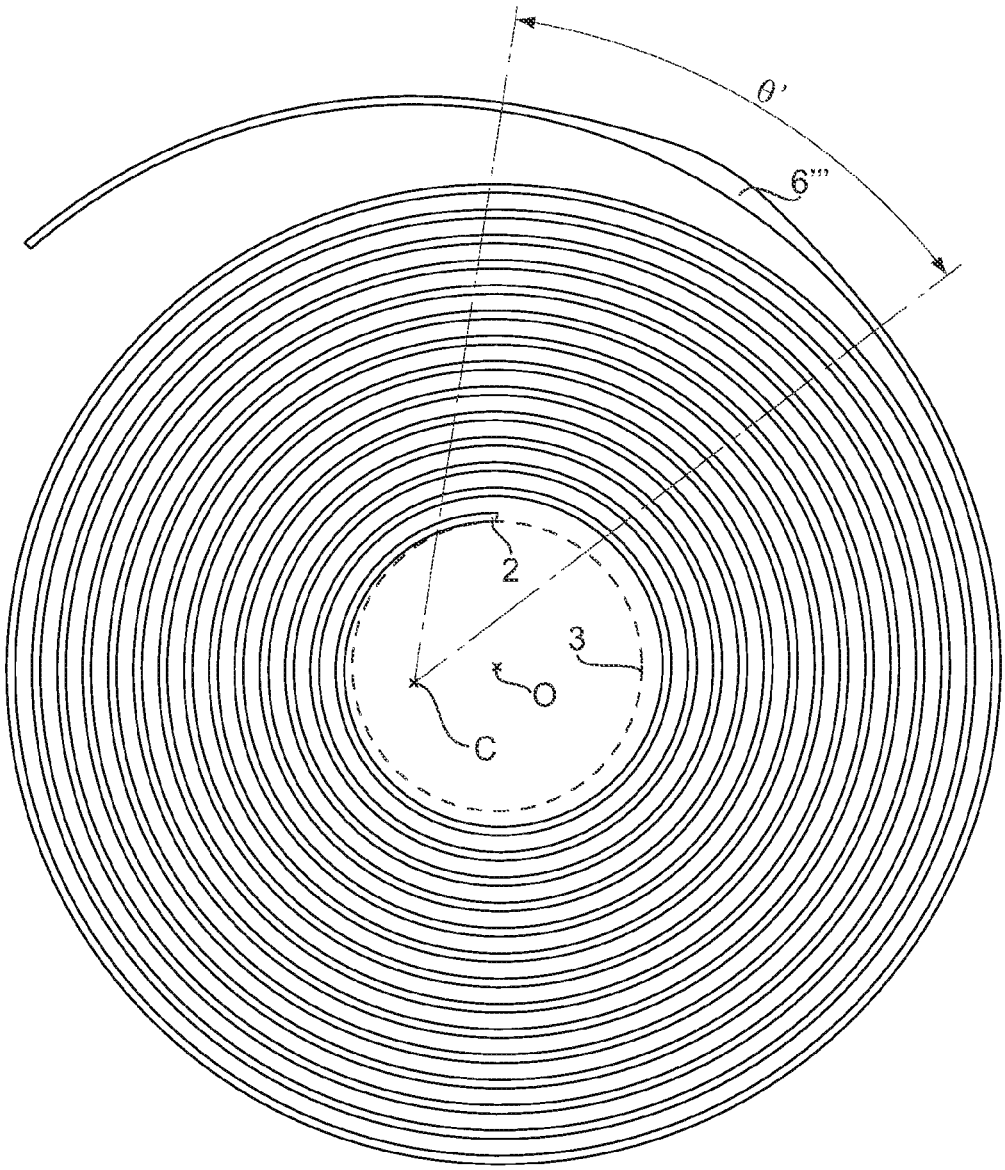
FIG. 9 shows a hairspring having a stiffened outer turn portion in accordance with a third embodiment of the invention.

Still another parameter of the stiffened portion having an influence on the isochronism is its extent θ. By decreasing the extent θ, a rate gain is produced at small oscillation amplitudes with respect to large oscillation amplitudes of the balance. Thus, for example, a rate deviation of about 6.9 s/d, but with the opposite sign compared with the average, measured rate deviation mentioned in relation to FIG. 3, can be obtained between the amplitudes of 150° and 300° by decreasing the angular extent θ of the stiffened portion to the value θ'=43.9° and by keeping the other characteristics of the stiffened portion (position, thickness or maximum of the thickness) constant. FIG. 9 shows the hairspring obtained, with its stiffened outer turn portion designated by reference numeral 6''', and FIG. 10 shows the isochronism curve I9 corresponding to such a hairspring.

In variations, the embodiments described above could, of course, be combined, i.e., at least two of the parameters α, e and θ could be modified.

The invention claimed is:

1. A timepiece movement comprising:

a balance-and-hairspring regulator and an escapement cooperating with the regulator, and the balance-and-hairspring regulator comprising a hairspring with an outer turn comprising a stiffened portion arranged to make the hairspring more concentric, wherein the stiffened portion is also arranged to produce a rate gain of at least 2 s/d at an amplitude of 150° with respect to an amplitude of 300° so as to at least partially compensate for the variation in the rate of the movement in dependence upon the oscillation amplitude of the balance caused by the escapement.

2. The timepiece movement as claimed in claim 1, wherein the stiffened portion is arranged to produce a rate gain of at least 4 s/d at an amplitude of 150° with respect to an amplitude of 300°.

3. The timepiece movement as claimed in claim 2, wherein the stiffened portion is arranged to produce a rate gain of at least 6 s/d at an amplitude of 150° with respect to an amplitude of 300°.

4. The timepiece movement as claimed in claim 3, wherein the stiffened portion is arranged to produce a rate gain of at least 8 s/d at an amplitude of 150° with respect to an amplitude of 300°.

5. The timepiece movement as claimed in claim 1, wherein the stiffened portion is closer to the outer end of the hairspring than a theoretical stiffened portion which would make the hairspring substantially perfectly concentric.

6. The timepiece movement as claimed in claim 1, wherein the stiffened portion is thinner than a theoretical stiffened portion which would make the hairspring substantially perfectly concentric.

7. The timepiece movement as claimed in claim 1, wherein the stiffened portion is less extended than a theoretical stiffened portion which would make the hairspring substantially perfectly concentric.

8. The timepiece movement as claimed in claim 5, wherein the thickness and extent of the stiffened portion are substantially identical to those of said theoretical stiffened portion.

9. The timepiece movement as claimed in claim 6, wherein the position and extent of the stiffened portion are substantially identical to those of said theoretical stiffened portion.

10. The timepiece movement as claimed in claim 7, wherein the position and thickness of the stiffened portion are substantially identical to those of said theoretical stiffened portion.

11. The timepiece movement as claimed in claim 2, wherein the stiffened portion is closer to the outer end of the hairspring than a theoretical stiffened portion which would make the hairspring substantially perfectly concentric.

12. The timepiece movement as claimed in claim 3, wherein the stiffened portion is closer to the outer end of the hairspring than a theoretical stiffened portion which would make the hairspring substantially perfectly concentric.

13. The timepiece movement as claimed in claim 4, wherein the stiffened portion is closer to the outer end of the hairspring than a theoretical stiffened portion which would make the hairspring substantially perfectly concentric.

14. A timepiece movement comprising:

a balance-and-hairspring regulator and an escapement cooperating with the regulator; and the balance-and-hairspring regulator comprising a hairspring with an outer turn comprising a stiffened portion arranged to make the hairspring more concentric, wherein the stiffened portion produces a rate gain of at least 2 s/d at an amplitude of 150° with respect to an amplitude of 300° by having, relative to a theoretical stiffened portion which would make the hairspring substantially perfectly concentric, one of (a) the stiffened portion being closer to an end of the hairspring, (b) the stiffened portion being thinner, and (c) the stiffened portion having a smaller angular extent, so as to at least partially compensate for variation in a rate of movement caused by an oscillation of the balance caused by the escapement, and wherein two of (a)-(c) other than the one are not different from the theoretical stiffened portion.

15. The timepiece movement according to claim 14, wherein the stiffened portion is (a), closer to the end of the hairspring than the theoretical stiffened portion which would make the hairspring substantially perfectly concentric.

16. The timepiece movement according to claim 14, wherein the stiffened portion is (b), thinner than the theoretical stiffened portion which would make the hairspring substantially perfectly concentric.

17. The timepiece movement according to claim 14, wherein the stiffened portion is (c), smaller in extent than the theoretical stiffened portion which would make the hairspring substantially perfectly concentric.

* * * * *